United States Patent [19]

Bernhardsson et al.

[11] Patent Number: 4,498,784

[45] Date of Patent: Feb. 12, 1985

[54] METHOD AND A DEVICE FOR MIXING AND HOMOGENIZATION OF A MAIN SUBSTANCE WITH AT LEAST ONE ADDITIVE SUBSTANCE, LIQUIDS IN PARTICULAR

[76] Inventors: Göran Bernhardsson, HedÅsgatan 4, S-412 53 Göteborg; Tomas Jargell, Bävernsgränd 2, S-753 23 Uppsala, both of Sweden

[21] Appl. No.: 394,922

[22] PCT Filed: Oct. 31, 1980

[86] PCT No.: PCT/SE80/00271

§ 371 Date: Jun. 28, 1982

§ 102(e) Date: Jun. 28, 1982

[87] PCT Pub. No.: WO82/01478

PCT Pub. Date: May 13, 1982

[30] Foreign Application Priority Data

Oct. 26, 1979 [SE] Sweden ..... 7908880

[51] Int. Cl.[3] ..... B01F 5/10

[52] U.S. Cl. ..... 366/134; 366/136; 366/159; 366/160; 366/182

[58] Field of Search ..... 137/98, 100; 366/131, 366/136, 137, 151, 152, 154, 159, 160, 167, 168, 171, 176, 182, 302, 303, 145, 134; 196/132

[56] References Cited

U.S. PATENT DOCUMENTS

| | | | |
|---|---|---|---|
| 2,435,884 | 2/1948 | Galewski | 366/136 |
| 2,503,228 | 4/1950 | Wanner | 366/168 |
| 2,682,883 | 7/1954 | Phillips | 137/98 |
| 3,802,515 | 4/1974 | Flamand | 415/502 |
| 4,007,921 | 2/1977 | Zingg | 366/136 |
| 4,085,766 | 4/1978 | Weigl et al. | 137/98 |
| 4,126,399 | 11/1978 | Schneider | 366/131 |
| 4,293,230 | 10/1981 | Tan et al. | 366/148 |
| 4,335,737 | 6/1982 | Power | 137/98 |
| 4,352,572 | 10/1982 | Chen et al. | 366/145 |

FOREIGN PATENT DOCUMENTS 389387 6/1971 Sweden .

*Primary Examiner*—Robert W. Jenkins
*Assistant Examiner*—Arthur D. Dahlberg
*Attorney, Agent, or Firm*—LeBlanc, Nolan, Shur & Nies

[57] ABSTRACT

A method of continuous mixing and homogenization of a main substance and at least one additive substance, liquids in particular, and a device for executing the method, said device comprising a primary conduit (1) for circulating the main substance, a secondary conduit (5) for circulating the main substance and the additive substance, to which conduit a mixing unit (7) is connected, and at least one proportioner (4) for supplying the additive substance, said proportioner constituting a connection between the primary and secondary conduits, the main substance and the additive substance being supplied to the secondary conduit in dependence of a discharge from the secondary conduit.

7 Claims, 5 Drawing Figures

Figure 1:
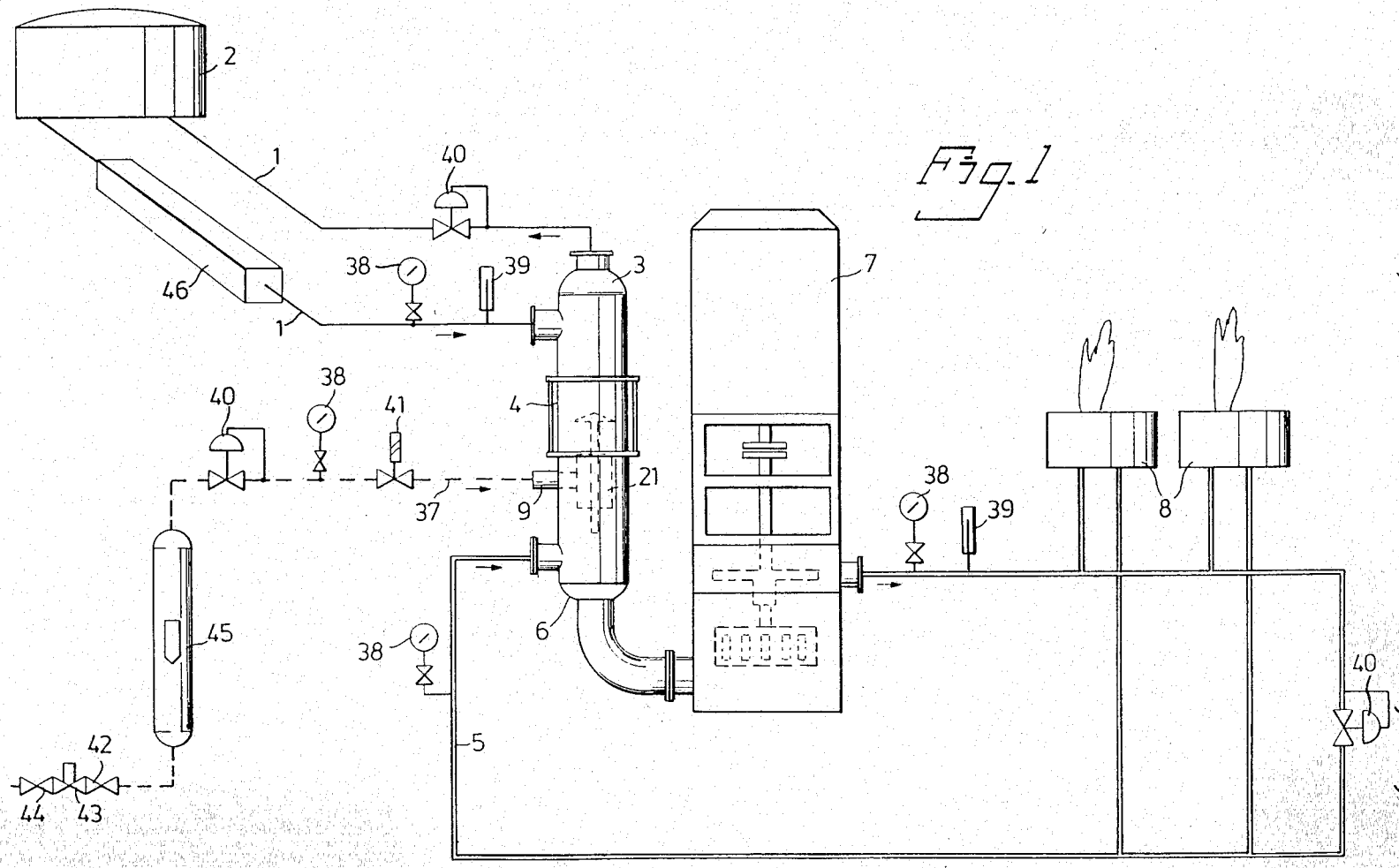

Fig. 2
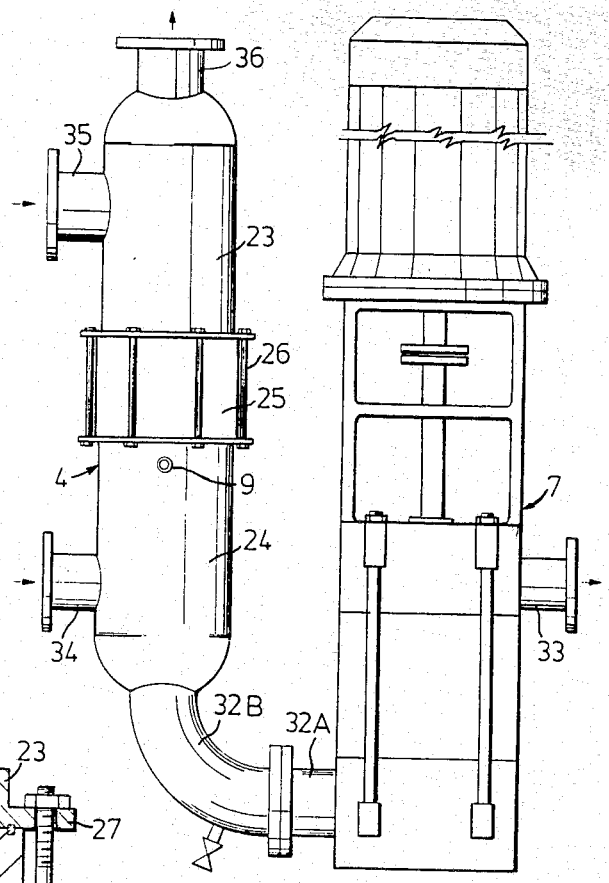
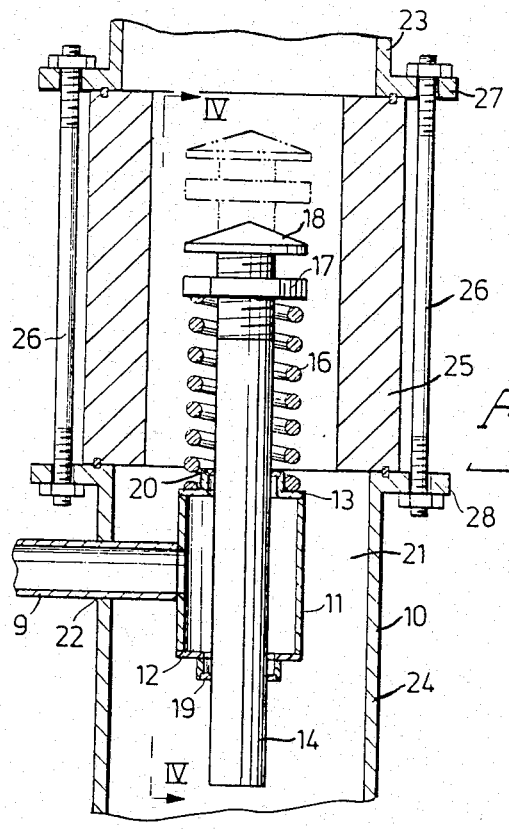
Fig. 3

METHOD AND A DEVICE FOR MIXING AND HOMOGENIZATION OF A MAIN SUBSTANCE WITH AT LEAST ONE ADDITIVE SUBSTANCE, LIQUIDS IN PARTICULAR

This invention relates to a method of continuous mixing and homogenization of a main substance with at least one additive substance, liquids in particular, in which method the substances are mixed together to constitute a homogenuous admixture. Further, the invention is in respect of a device for carrying out the method.

More particular, the invention relates to a method and a device for continuous mixing and homogenization of oil with water as an additive.

When speaking of problems involved with the burning of heavy oils one encounters primarily two types of problems. For one thing, the ones who get into daily touch with furnaces experience problems with furnace clogging, soot, operational brake-down, coke, residues and other operational problems, for another people worry about environmental injury, dust discharge, sulphur discharge and other environmental problems.

By emulsifying water in the oil in a proper manner, a second distribution is obtained when the oil spray enters the combustion chamber of a furnace. Extensive measurements have shown that the dust discharge has been reduced by more than 90% and at the same time in a plurality of the cases the soot removal periods have been prolonged from each fortnight to once each half year. Consequently, a next to complete combustion of the emulsified fuel is obtained.

The burners may be fed with such emulsified fuel in a plurality of manners. Obviously it would be most convenient if the oil suppliers could deliver an oil which is already emulsified with water in a correct manner. However, an emulsion oil-water is not entirely stable, wherefore this procedure is not be considered as a possibility.

According to another method, the water is emulsified into the oil centrally for a boiler plant, i.e. an apparatus common to all boilers and burners is installed somewhere in an oil distribution circulation loop. An apparatus is available on the market which is designed to be installed according to this principle. This apparatus functions in such manner that the oil is brought to a suitable pressure (7–8 bar) by a pump, the pressure of the water being increased in a corresponding manner. The two liquids are then sprayed against each other by each passing a number of mutually opposite nozzles. After having been treated in this manner, the emulsion flows to a container, the volume of which is about 10% of the top capacity of the apparatus per hour. The container has a connection to the atmosphere, the gauge pressure being zero. (In consequence hereof, the temperature of the oil cannot be allowed to surmount abount 70° C., this with respect to the light components of the oil, and under no circumstance not surmount 100° C. with respect to the boiling point of the water.) A centrifugal pump is arranged within said container for repressurizing the oil and transporting the emulsion to the burners. This pump is over-dimensioned to deliver an overflow of emulsion, thus operating as a means for dispersing and homogenizating the water in the oil. This centrifugal pump of the apparatus operates continuously, the two other pumps, however, operating intermittently to fill up the container. When the container is being emptied, the oil and water pumps are at rest. The oil and water pumps are controlled by separate level monitors in the container, alone or in combination with a timer.

According to still another method, emulsifying means are arranged for each burner. Said means will have to be inexpensive in order to be of interest. As a rule, in an installation of this kind, one or more nozzles are installed in the oil supply tube, water being ejected into the oil passing by. The number of operating nozzles is controlled by limit switches combined with the control motor of the burner. This construction results in a poor dispersion and distribution of the water within the oil, and in addition thereto the water content of the emulsion will vary with load due to a step-wise admixture of the water.

It is an object of the present invention to solve the problems touched above and involved with the prior art devices, and to provide a method which leads to a substantial reduction of operational brake-downs, diminishes the sooting operations, considerably diminishes the dust ejection and is economically favourable in a comparison with burner equipments operating without water emulsification.

A further object of the present invention is to provide a device of the kind mentioned above to carry through the method, said device being simple and dependable as to construction and function.

Said objects are attained according to the invention, firstly, by utilizing a method which is characterized by the fact that the main substance is circulated in a primary conduit, that the additive substance is added to the main substance between said primary conduit and a secondary conduit, within which the main substance and the additive substance are mixed together and circulated, the main substance and the additive substance being supplied to the secondary conduit in dependence of the discharge from the secondary conduit, secondly, a device for executing said method, this device being characterized by comprising a primary conduit for circulating the main substance, a secondary conduit for circulating the main substance and the additive substance, a mixing apparatus being connected to said secondary conduit, and at least one measuring apparatus, a proportioner, connected in circuit between said primary and secondary conduits for introducing the additive substance, as well as means for introducing the main substance and the additive substance to the secondary conduit in dependence of a discharge of the admixed substances form the secondary conduit.

The method and the device according to the invention can to advantage be used for an entire steam boiler plant for burning heavy oil, but may as well be adapted for a single burner due to the low cost of the device.

Water is admixed continuously as the emulsion is used. The water content (percentage) will always be constant, independently of the oil flow. The emulsification of the water in the oil proceeds without significant decrease or increase of the oil pressure, wherefore the energy consumption therefore will remain at a minimum. Due to the fact that the emulsification is carried through in an entirely closed system, the device is next to independent of oil temperature.

The device is built into the system in such a manner that it is split up into two parts, one part in which the oil is as yet not emulsified with water and one part where it is emulsified. The portion of the oil to be consumed is conducted to the proportioner and the portion not to be consumed returns to tank. The portion to be consumed passes down through a throttling means within which the proportioner is arranged. The proportioner admits water to the oil in the same proportion as oil is passing the proportioner. When the oil passes the proportioner it exerts a pressure on a hat-shaped plate thereof, a pressure which varies in proportion to the square of the velocity of the oil and, consequently, the volume flow. This pressure is counteracted by an helical spring, the force of which is proportional to its length variation, the travel of the spindle of a valve controlling the water flow thus being proportional to the flow of the passing oil. The spindle has the shape of a tube provided with an aperture extending in its axial direction in such a manner that the part of the aperture in connection with the water supply is proportional to the throw of the spindle. By maintaining the water pressure constant on the upstream side of the proportioner valve, the water flow entering the oil will be proportional to the aperture area and, consequently, to the passing oil flow. After having passed the throttling means, the mixture of oil and water is conducted through a mixing unit comprising a rotary shaft motor and a mixing chamber, within which a rotor and a stator are arranged (according to, for instance, the Swedish Pat. No. 167 235), and a pump impeller. Within the chamber the emulsion is circulated under overflow, the water being thoroughly dispersed in the oil (SE-PS 198 380). Further, the oil, brought to an elevated pressure by the impeller, is exposed to a circulation within the secondary conduit constituting a loop from an outlet of the chamber. Such part of the oil which is not taken out from the conduit loop for combustion returns to the mixing unit through an inlet to the mixing chamber thereof. This inlet is arranged downstream of the throttling means to the effect that no emulsion can enter the primary circulation system and thus return to the oil tank. Further, this construction provides a possibility for possibly present air to pass upwardly through the throttling means into the oil tank, providing for a deaeration of the secondary conduit containing the emulsion.

Figure 4:
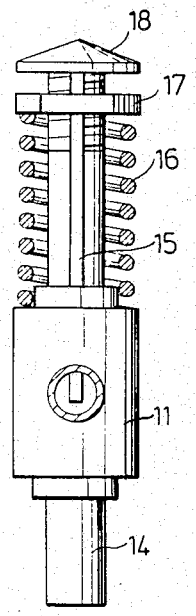

The invention will be more closely described in the following with reference to the accompanying drawings, on which FIG. 1 is a diagrammatic view of an embodiment according to the invention for mixing and homogenization of heavy oil, FIG. 2 is a side view of a proportioner and a pump and mixing unit of this embodiment according to the invention, FIG. 3 is a partial cross-section through the proportioner, FIG. 4 is a view turned 90° relative to FIG. 3 of a control valve of the portioner, and FIG. 5 a side view, partly sectioned, of the pump and mixing unit.

FIG. 1 shows a device for mixing and homogenization of a main substance, heavy oil in particular, with an additive substance, water in particular, said device comprising a primary conduit 1, through which the heavy oil circulates from a tank container 2 to the inlet side 3 of a proportioner 4 and therefrom back to the tank container 2, a secondary conduit 5, extending from an outlet 6 of the proportioner 4 via a pump and mixing unit 7 and a number of burners 8, of which two are shown but the number of which can, of course, vary, and then back to the proportioner adjacent the outlet 6 thereof.

The proportioner 4, the cross-section of which is shown in FIGS. 3 and 4, comprises a tube 9 which is connected in such a way to a water source, that the water arrives to the tube 9 under pressure, a cylinder 11 attached to the internal end of the tube 9 within the housing 10, this cylinder 11 being closed at its ends by annular flanges 12 and 13, a hollow, circularly cylindric valve spindle 14 which is axially displacable within the cylinder 11 and has a slot 15 (see FIG. 4) extending from the upper end, and a helical spring 16 enclosing the valve spindle 14 and abutting with its ends against the upper annular flange 13 of the cylinder 11 and a nut 17 threaded on the upper part of the valve spindle. Correspondingly, the valve spindle is provided with an external thread at its upper part in engagement with the thread of the nut, to make possible an adjustment of the position of the nut along the valve spindle. The valve spindle is open at its lowest end and closed at its top. In the embodiment as illustrated, a hat-shaped, upwardly conical plate 18 is attached to the valve spindle on the top thereof, by screw joint, for instance, said plate closing the upper end of the spindle. Sealing gaskets 19, 20 are arranged at the annular flanges 12, 13 for sealing around the outer periphery of the valve spindle 14. The cylinder 11, the valve spindle 14 and the rest of the details constituting a valve 21 are secured in proper position and held by the tube 9 which is connected to the wall of the housing 10 at 22. The housing 10 is subdivided in an upper part 23, a lower part 24 and an exchangeable intermediary part 25, secured by means of screws 26 arranged around the housing and tightened to the flange portions 27 and 28, respectively, at the lower and upper, respectively, ends of the upper and lower parts 23 and 24. The intermediary part 25 can be exchanged to vary the through-flow area of the housing 10. In the same manner, the plate 18 can be substituted by a plate having other diameter. Therewith, the degree of proportioning may be changed by the following parameters: The internal cross-section area of the intermediary part of the housing, the plate diameter, the spring characteristic, the positioning of the nut, and by changing the difference in pressure of the additive substance in the conduit 37 and the main substance in the proportioner.

Figure 5:
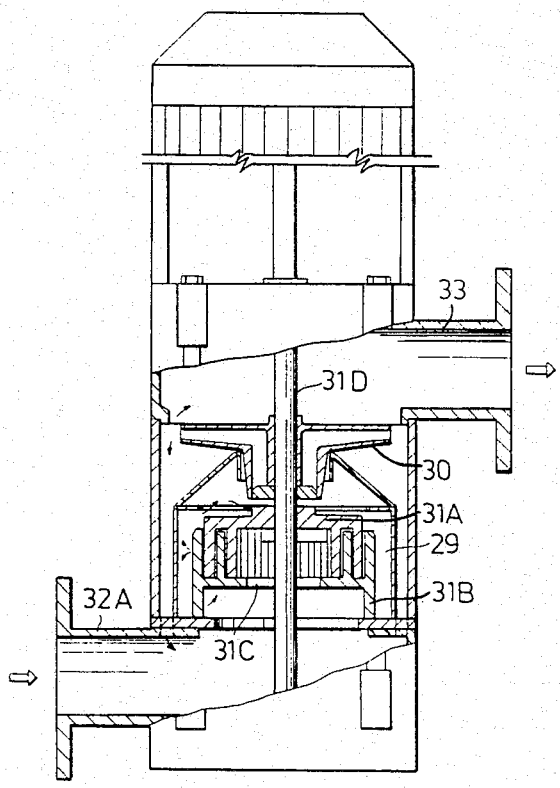

FIG. 5 shows a side view, sectioned in parts, of the pump and mixing unit 7, said unit comprising a mixing apparatus 29 and a pump impeller 30. The mixing unit shown is of a type having an upper rotor 31A and a lower stator 31B. In operation oil and water are sucked in through the inlet 31C of the stator 31B and forced outwardly between the blades of the stator and rotor which are overlapping each other and directed in opposite directions. The blades are arranged at such angles, as seen in the direction of rotation, that the mixing apparatus obtains some pumping capacity. To obtain a circulation through the secondary conduit 5 the unit comprises a pump impeller, preferably arranged coaxially with the mixing apparatus, a shaft 31D driving the mixing apparatus 29 and the pump impeller 30. Oil and water enter the unit through an inlet 32A and leaves the unit through an outlet 33, the inlet 32A being connected to an outlet 32B at the bottom of the proportioner 4. The secondary conduit is connected to a lower inlet 34 of the proportioner 4 and to the outlet 33 of the pump and mixing unit 7. The primary conduit 1 is connected to the proportioner 4 upper inlet 35 and outlet 36, respectively.

As shown in FIG. 1, a number of instruments are connected to the primary and secondary conduits 1 and 5, as well as to a water supply conduit 37, by which the water is supplied to the annular chamber between the cylinder 11 and the valve spindle 14. Conveniently, these instruments are arranged for trimming the entire device and may then be removed. Pressure gauges are installed on all conduits, other auxiliary means are thermometers 39, valves, such as pressure control valves 40 and magnet, check, vacuum, and stop valves 41, 42, 43, and 44, respectively, as well as a flowmeter 45, shown as being of the float type, for the water. Further, the primary conduit comprises an equipment 46 containing pumps and preheaters for the heavy oil. The direction of flow of oil and water is shown in FIG. 1 by arrows.

The operation of the device may be described as follows.

Heavy oil is circulated in the primary conduit 1 from the tank by means of pumps contained in the equipment 46. When starting the burners 8, implying that an oil-water mixture is discharged from the secondary conduit 5, oil is automatically discharged from the primary conduit 1 through the proportioner 4, this due to the fact that the pressure prevailing in the primary conduit 1 is higher than the pressure within the secondary conduit 5. Oil flowing through the proportioner exerts a pressure onto the valve spindle 14, pressing it down into the cylinder 11, to the effect that the slot 15, which in the unloaded state of the spindle is located entirely above the cylinder 11 (as illustrated by dashed lines in FIG. 3), enters the cylinder to make possible an entrance of water from the conduit 37 to be carried by the oil to the secondary conduit 5. As mentioned above, the valve 21 is so designed that the composition of the oil-water mixture remains constant because of the fact that the travel of the valve spindle within the cylinder and the entrance of the slot into the cylinder, respectively, is proportional to the oil flow through the proportioner 4. As mentioned, the valve may be adjusted, that is, the degree of water admittance may be varied, by changing a number of parameters. After having passed by the valve 21, the oil and water enter the pump and mixing unit 7, to first arrive to the mixing apparatus 29, within which the mixture of oil and water can flow as illustrated in FIG. 5 by arrows. Thus, the oil-water mixture may pass the mixing apparatus a plurality of times before being finally expelled by the pump impeller 30. This leads to a homogenous mixture of oil and water, required for attaining the intended result by means of the device. As will be evident from FIG. 5, part of the oil-water mixture can flow back to the mixing apparatus 29 after having been ejected by the pump impeller 30. If necessary, a plurality of pumps and/or a plurality of mixing apparatuses may be arranged as components of the secondary conduit. Such pumps and mixing apparatuses may conveniently be arranged coaxially with each other to make possible a simpler and less costly operation thereof.

Although in the above described and preferred embodiment the proportioner comprises only one single valve, a plurality of valves may be arranged after each other within the proportioner in case two or more additive substances are to be admixed to the main substance discharged from tank. Obviously, it is as well possible to arrange the spring control means of the proportioner outside the housing of the proportioner and outside such components by which the substances are enclosed.

The invention is, of course, not restricted to the embodiment described above and shown by the drawings, but may be modified within the scope of the appending claims.

We claim:

1. A method of continuous mixing and homogenization of a main substance with at least one additive substance, liquids in particular, characterized by the fact that the main substance is circulated in a primary conduit, that the additive substance is added to the main substance between said primary conduit and a secondary conduit, formed as a closed circuit within which the main substance and the additive substance are mixed together and circulated, whereby the pressure provided in the primary conduit is higher than the pressure in the secondary conduit, so that the main substance and the additive substance are supplied to said secondary conduit in dependence of a discharge from said secondary conduit.

2. A method according to claim 1 characterized in that said additive substance is added to said main substance in dependence of the velocity of the main substance through a proportioner arranged between said secondary and primary conduits.

3. A device for continuously mixing and homogenization of a main substance with at least one additive substance, liquids in particular, characterized by comprising: a primary conduit (1) for circulating said main substance, a secondary closed conduit means (5) for circulating the main substance and said additive substance, conduit means including a mixing unit (7) and at least one proportioner (4) for admixing the additive substance, with said main substance, said proportioner being inserted between and connected to said primary conduit and secondary conduit means and including means to provide a higher pressure in the first conduit than in the second conduit means, so that the main substance and the additive substance are supplied to the secondary conduit means in dependence of a discharge of the admixed substances from the secondary conduit means.

4. A device according to claim 3, including a tank for the main substance and characterized in that said primary conduit extends from said tank for the main substance in a loop back to the tank, a pumping means being disposed in connection with the primary conduit to circulate the main substance therethrough, and an outlet of the primary conduit is connected to an inlet of the proportioner.

5. A device according to claim 3, characterized in that said secondary conduit means extends as a closed loop from an outlet of the proportioner, a pump means is included in circuit with the secondary conduit means to circulate the homogenized main and additive substances through the secondary conduit to which at least one consumer unit for the mixture is connected, the mixing unit being arranged ahead of said mixture consuming unit as seen in the direction of flow and after a connection of the closed loop to the proportioner at the outlet side thereof.

6. A device according to claim 5 for mixing and homogenization of oil and water, characterized by the consumer unit being a burner (8).

7. A device according to claim 3, characterized by means for admitting the additive substance under pressure.

* * * * *